US005829736A

United States Patent [19]

Harken

[11] Patent Number: 5,829,736

[45] Date of Patent: Nov. 3, 1998

[54] WINCH HAVING DRUM OF TWO DIAMETERS FOR ALTERNATIVE ENGAGEMENT BY A LINE AT TWO SPEEDS

[75] Inventor: Peter O. Harken, Pewaukee, Wis.

[73] Assignee: Harken, Inc., Pewaukee, Wis.

[21] Appl. No.: 516,529

[22] Filed: Aug. 18, 1995

[51] Int. Cl.[6] ..... B66D 1/26

[52] U.S. Cl. ..... 254/278; 254/374; 254/295; 242/903

[58] Field of Search ..... 254/278, 374, 254/344, 295, 297, 371; 242/903

[56] References Cited

U.S. PATENT DOCUMENTS

| | | | |
|---|---|---|---|
| 1,235,504 | 7/1917 | Ross | 242/903 X |
| 1,424,990 | 8/1922 | Coyle et al. | 254/344 |
| 1,565,720 | 12/1925 | Estes | 242/903 X |
| 1,568,406 | 1/1926 | Le Bus | 254/278 X |
| 2,435,580 | 2/1948 | Glennon | 254/295 X |
| 2,513,095 | 6/1950 | Hunt | 254/278 X |
| 3,432,146 | 3/1969 | Schubert et al. | 254/374 |

FOREIGN PATENT DOCUMENTS

| | | | |
|---|---|---|---|
| 28375 | 8/1921 | Denmark | 254/278 |
| 1281654 | 10/1968 | Germany | 254/278 |
| 2944715 | 5/1981 | Germany | 254/278 |
| 11048 | 6/1900 | United Kingdom | 254/278 |
| 340427 | 1/1931 | United Kingdom | 254/278 |

*Primary Examiner*—Donald P. Walsh
*Assistant Examiner*—Emmanuel M. Marcelo
*Attorney, Agent, or Firm*—Juettner Pyle Piontek & Underwood

[57] ABSTRACT

A sailboat winch used for trimming lines of alternate sails, such as a jib and a spinnaker, has a drum with upper and lower drum portions of different diameters separated by a continuous radially projecting lip. The upper drum portion has a first diameter and is used for trimming the jib at maximum power. The lower drum portion has a diameter greater than the first diameter and is used for trimming the spinnaker lines. The radial extent of the lip is sufficient to prevent a line, when wrapped on the lower drum, from slipping upwardly and becoming disengaged from the lower drum.

7 Claims, 1 Drawing Sheet

WINCH HAVING DRUM OF TWO DIAMETERS FOR ALTERNATIVE ENGAGEMENT BY A LINE AT TWO SPEEDS

Background of the Invention

Winches are widely employed on sailing vessels to provide a mechanical advantage while hauling in of a line. These devices, comprising a rotatable drum and an internal pawl mechanism to allow rotation of the drum in one rotary direction, are typically mounted on the deck or mast of a sailboat. Lines connected to the rigging or sails have free ends, which may be wrapped around the drum of the winch for a number of turns. Smaller winches are cranked by a crank handle inserted in the top of the winch. Larger winches may be driven from the bottom, either by a separate manual crank or by a motor. Friction between the drum and the line allows the line to be drawn in using the crank, or eased out gradually or suddenly by hand.

Many sailboat winches have internal gearing to provide more than one speed ratio of the drum relative to the rotation of the cranking device. When the line is relatively slack, a high gear ratio may be employed, and when tension increases, a lower gear ratio may be engaged. In modem sailboat winches, gear selection is automatic upon reversal of direction of the drive input. For example, a two speed winch has a unidirectional drive permitting rotation in only the clockwise direction. When the crank handle connected to the main drive shaft of the winch is driven in the clockwise direction, the drum is driven in a first, high, gear ratio. If the crank handle is driven in the counterclockwise direction, the winch drum is driven in a clockwise direction in a lower, second gear.

Deck mounted primary winches on sailboats are used to haul in and ease out sheets or lines attached to a foresail such as a jib or genoa when the boat is sailing at an acute angle to the wind. The same deck winch is also used to control different lines attached to a spinnaker when the boat is sailing off the wind. Since the jib sheet carries the maximum load, the power ratio of the winch, determined generally by the size and drum diameter of the winch, must accommodate this maximum load. For spinnaker work, the loads are less, and the ability to sheet in and out quickly to maintain sail shape is a primary concern on racing sailboats. For this reason, winches are sometimes equipped with additional internal gears to better accommodate the two different operating conditions, but this results in increased costs, as well as increased complexity and weight of the winch.

SUMMARY OF THE INVENTION

In accordance with the present invention, the drum of an otherwise conventional winch is modified to include an upper substantially cylindrical line engaging portion or drum having a first diameter relating directly to the power ratio of the winch in lowest gear. The upper cylindrical portion has a first height or length and has an outwardly projecting top lip and an outwardly flared bottom skirt, as in a conventional winch drum. This portion or drum is employed to trim sheets or lines connected to a foresail when maximum power is required.

The internal gearing for the winch is not shown, but it is conventional and is shown in a catalog available from Harken, Inc., Pewaukee, Wis., or in available patent literature.

The winch drum also has a second lower line engaging cylindrical portion or second drum with a diameter substantially greater than the diameter of the upper portion. A continuous outwardly projecting lip is provided between the upper and lower cylindrical portions, with the radial dimension of the lip being greater than the maximum diameter of a line to be received by the winch. For spinnaker work, the line may be wrapped around the lower, larger diameter portion for hauling in and easing the line more rapidly. In effect, for example, a winch having a first and second internal gear mechanism will also have a third and fourth ratio or speed by means of the two diameters of the drum. The height or length of the second cylindrical portion may be less than that of the upper portion, since fewer turns of the line are required in this mode, or the line diameter is less than the diameter used in the first mode.

The winch drum may be manufactured as a unitary member, or a standard or existing winch drum may be converted by securing a fabricated ring-shaped member to the lower portion of the drum.

DESCRIPTION OF THE PREFERRED EMBODIMENT

Figure 1:
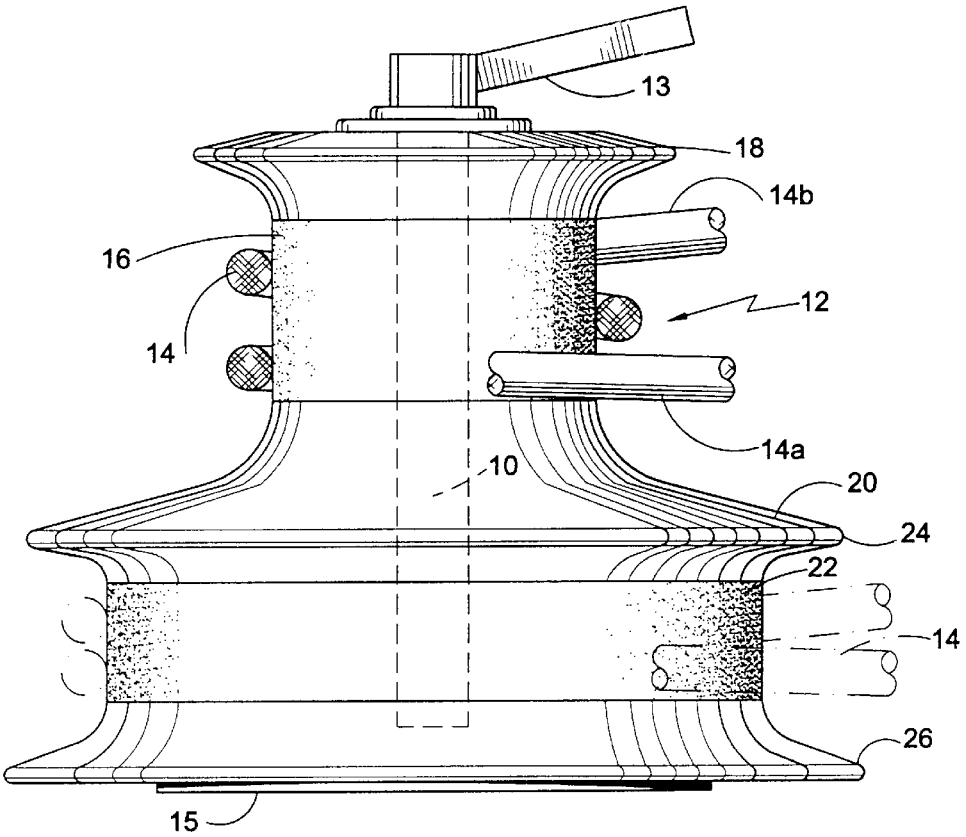
FIG. 1 is a side view of a sailboat winch having a unitary drum in accordance with the present invention and showing a line, partly in cross section, engaging the upper portion of the drum.

FIG. 1 shows the exterior of a winch having a conventional internal working mechanism. The winch includes a main drive shaft 10 connected by internal gearing (not shown) to the drum of the winch, generally shown at 12. A conventional crank handle, a portion of which is shown at 13, is manually cranked to rotate the drum, usually in a unidirectional clockwise direction. The drum 12 is rotatably mounted on a fixed support base 15 secured to the deck, with the drum being rotatable around a central vertical axis.

The drum 12 comprises an upper substantially cylindrical portion 16 having a first diameter, the surface of which may be roughened as shown for better friction with the line 14 engaged thereon. The upper portion includes a top continuous and radiused lip 18 which extends radially outwardly around the drum with respect to the upper cylindrical portion 16 and a lower outwardly flaring portion or skirt 20. When the winch is operated in a first mode, the line 14 is wrapped around the upper cylindrical portion. The lower section of line or jib sheet 14*a* leads forwardly in the boat to the sail and is the loaded portion, and the upper portion 14*b* is the relatively unloaded portion of the line and leads to the free end. The relatively untensioned portion 14*b* is trimmed or pulled by hand as the winch is being cranked. As the winch is cranked, the line is drawn in from the bottom of the drum and exits at the top.

The drum 12 additionally comprises a lower line receiving cylindrical portion 22 having a second diameter greater than the diameter of the first portion 16. In the embodiment shown, the lower portion of the skirt 20 is radiused inwardly to provide a radiused lip 24 extending around the drum radially outwardly relative to the portion 22. The lower portion also includes a bottom lip 26 extending radially outwardly.

Figure 2:
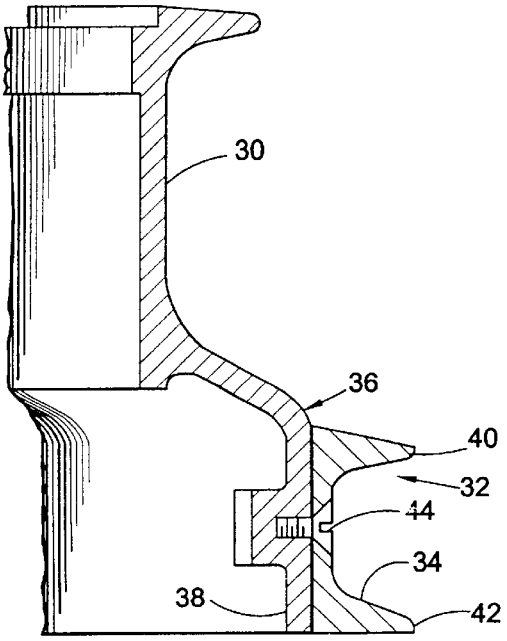
FIG. 2 is a vertical sectional view through the drum of a conventional winch with a conversion ring-shaped part attached in accordance with the present invention.
Figure 3:
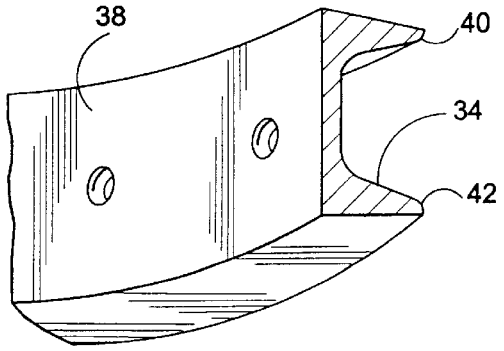
FIG. 3 is a perspective view of a section of the ring-shaped part shown in FIG. 2.

FIGS. 2 and 3 show another embodiment in which a conventional winch drum 30 is provided with a separate ring shaped part 32 to provide a second line receiving portion 34 of greater diameter than the diameter of the main drum. In this case, the standard winch drum 30 has a lower skirt 36 having a cylindrical outer surface. The ring-shaped part has an inner surface 38 conforming to the shape of the skirt, and an outer portion comprising a pair of spaced annular jaws or lips 40 and 42. The ring member 32 is secured to the lower part of the winch by means of bolts 44, or by other means, such as pins or permanent adhesive.

For operation in the second or spinnaker mode, the control line from the spinnaker is usually led from a block attached to an aft part of the boat and back to the winch. The line is wrapped in a spiral one or more turns around the lower drum. Since the loads exerted on the line by the spinnaker are generally less than when in the first mode, the larger drum diameter allows for more rapid trimming per turn of the winch handle without exertion of undue effort.

As shown in FIG. 1, since fewer wraps of line are required on the drum when operating in the second mode the length of the lower cylindrical portion 22 may be less than that of the upper portion 16. Also, the radial extent of the central lip 18 must be sufficient to prevent the line under moderate tension from slipping upwardly from the lower drum 22 when the winch is being cranked and fresh line is being drawn onto the bottom of the drum and is being moved upwardly in a coil on the lower drum. The radial extent or width of the lip 24 is therefore preferably greater than the radius of the line and most preferably greater than the maximum diameter of the line to be employed on the lower drum.

It will be understood that the two diameter drums of the present invention offers two separate but alternate selections of speed by winding a line on one or the other drum diameters. It is not contemplated that both modes could be used simultaneously or that one line would be wrapped around both drum diameters at the same time. The intermediate lip 24 prevents the line from slipping onto the upper drum when the lower drum is engaged.

The relative diameters of the two drums may be selected to provide the desired gear ratio or speed. As one example, for a winch having an upper drum diameter of about three inches, good results are obtained by providing a lower drum diameter of about six inches, or from about 1.5 to about 3 times the diameter of the upper drum.

The winch drum of the present invention offers a considerable advantage in that the modified drum, either in unitary or composite form, may be retrofitted to an existing conventional winch, thus providing additional speeds without the need to replace the entire winch.

What is claimed is:

1. A sailboat deck winch and line system for trimming lines at two different speeds comprising a drum rotatably mounted on a base support, said drum having a top and a bottom, means for rotating said drum around a central axis, and a single line having a radius in wrapping engagement with said drum, said drum comprising an upper portion having a first diameter, a lower drum portion adjacent the base having a second diameter greater than said first diameter, a first and second lip extending radially outwardly around said drum at the top and the bottom of the drum, and restraining means comprising a third continuous lip extending radially outwardly around said drum between the upper and lower portions thereof for preventing migration of said line between said upper and lower portions of said drum, said line being wrapped around only one of the upper and lower drum portions to provide first and second speeds of operation, said lips preventing slippage of the line from the drum portion around which the line is wrapped.

2. The winch of claim 1 wherein the third lip has a radial extent greater than the diameter of the line.

3. The winch of claim 1 wherein said drum has a surface area having a length parallel to said central axis, and the upper drum portion is longer than the lower drum portion.

4. The winch of claim 1 wherein said drum is of unitary construction.

5. The winch of claim 3 wherein said drum comprises a conventional winch drum having a lower section and said second and third lips and said lower drum portion comprises a separate ring-shaped member secured to said lower section.

6. The winch of claim 1 wherein said winch has a maximum power ratio corresponding to the diameter of the upper drum portion.

7. A two speed winch and line system comprising a support, a rotatable drum mounted on the support, said drum comprising a lower portion adjacent said support and an upper portion, said upper portion having a first diameter and said lower portion having a second diameter larger than said first diameter, restraining means comprising a continuous lip extending outwardly from said drum between said upper and lower portions, power means for rotating said drum in at least one direction, and a single line having a portion in coiled engagement with said drum for drawing in said line upon operation of said power means, said line being coiled only around the upper portion of the drum in a first speed of operation and, alternatively, only around the lower part of the drum in a second speed of operation, said restraining means preventing migration of the line between said upper and lower portion of the drum upon operation of said power means.

* * * * *